United States Patent [19]

Fujisawa et al.

[11] Patent Number: 5,067,851

[45] Date of Patent: Nov. 26, 1991

[54] COLLAPSIBLE SHEET DAM

[75] Inventors: Masao Fujisawa, Chigasaki; Satoshi Tagomori, Yokohama; Mamoru Takasaki, Tokyo; Yoshihiro Sato, Yokohama, all of Japan

[73] Assignee: Bridgestone Corporation, Tokyo, Japan

[21] Appl. No.: 634,904

[22] Filed: Dec. 27, 1990

[30] Foreign Application Priority Data

Dec. 28, 1989 [JP] Japan ..... 1-338332

[51] Int. Cl.[5] ..... E02B 7/04

[52] U.S. Cl. ..... 405/115; 405/91

[58] Field of Search ..... 405/87, 91, 107, 115, 405/90

[56] References Cited

U.S. PATENT DOCUMENTS

| | | | |
|---|---|---|---|
| 3,173,269 | 3/1965 | Imertson | 405/115 X |
| 3,834,167 | 9/1974 | Tabor | 405/115 |
| 4,279,540 | 7/1981 | Suga et al. | 405/115 |

*Primary Examiner*—David H. Corbin

*Attorney, Agent, or Firm*—Sughrue, Mion, Zinn, Macpeak & Seas

[57] ABSTRACT

A collapsible sheet dam comprises a bag of flexible rubber sheet fixed onto a riverbed and riverbank portions of a river, and a fluid supply and discharge port formed in the bag. In such a dam, an end portion of the bag is fixed onto the riverbed and riverbank portions at upstream side and at the same time a portion of the bag located behind the fluid supply and discharge port is fixed onto the riverbank portion and a region ranging from the riverbank portion to the riverbed portion around the fluid supply and discharge port.

6 Claims, 4 Drawing Sheets

COLLAPSIBLE SHEET DAM

BACKGROUND OF THE INVENTION

1. Field of the Invention

This invention relates to a flexible sheet dam used an an intake weir for catching agricultural water or the like.

2. Related Art Statement

Heretofore, a collapsible rubber dam, employed a flexible rubber bag attached onto a riverbed and both riverbank portions to cross a river and a supply. A discharge means was arranged on the riverbank portion, and this structure has commonly been used. In this case, a fluid such as air or water was supplied into the inside of the rubber bag through the supply and discharge means to inflate the bag, while the fluid filled in the bag was discharged through the supply and discharge means to deflate the bag.

As a means for attaching the rubber bag to the river, a one-side fixing system is known in which only one side edge of the rubber bag was fixed to the riverbed and riverbank portions in an upstream side, and a two-side fixing system in which both side edges of the rubber bag were fixed at a given interval in upstream and downstream sides used as a tide weir.

According to the conventional technique, the above one-side fixing system is used when the water depth at the downstream side of the dam is usually low in general rivers or the like. In this case, there is caused no serious problem as much as the dam is used at such a state. However, when the river width becomes narrow toward the downstream side, or when plural dam gates are successively deflated, if the water depth at the downstream side of the dam increases at the deflation stage of the rubber bag, water pressure is applied to the rubber bag from the downstream side to create a force of raising the rubber bag, and consequently the rubber bag is elongated to cause cramping of a portion fixing the supply and discharge tube and a top of an upper portion fixed onto each riverbank.

In case of the two-side fixing system, the rubber bag is fixed at the upstream side and downstream side, so that the force of raising the rubber bag can be controlled to a certain extent to prevent the above cramping. In this case, however, the production cost of the dam structure is increased due to the increase in the number of fitting members and the working step number. Furthermore, when the flow rate is particularly slow or the water depth at the downstream side increases during the deflation of the rubber bag, as shown in FIGS. 9*a* to 9*e*, a portion of the rubber bag facing the downstream side is bent between the two fixed positions and the deflated shape of the rubber bag becomes higher at the downstream side, so that the sectional shape of water flowing over the dam is crashed to badly affect the flowing in the river. Furthermore, the formation of the bent portion in the rubber bag brings about damage of the bag.

SUMMARY OF THE INVENTION

It is, therefore, and object of the invention to overcome the above problems and to provide a collapsible sheet dam causing no cramping and bending.

According to the invention, there is the provision of a collapsible sheet dam comprising a bag of flexible rubber sheet fixed onto a riverbed and riverbank portions of a river in a direction crossing with the river, and a fluid supply and discharge port formed in the bag so as to open to to a surface of the riverbank portion for the inflation and deflation of the bag, characterized in that an end portion of said bag is fixed onto said riverbed and riverbank portions at an upstream side of the river and at the same time a portion of the bag located behind the fluid supply and discharge port is fixed onto the riverbank portion and a region ranging from the riverbank portion to the riverbed portion around the fluid supply and discharge port.

In the collapsible sheet dam according to the invention, even if the water depth at the downstream side of the dam increases, there is caused no cramping of the fixed portion of the bag located at an upstream side top of the riverbank portion and the portion of the bag surrounding the fluid supply and discharge port and also there is formed no bent portion of the bag during deflation of the bag.

BRIEF DESCRIPTION OF THE DRAWINGS

The invention will be described with reference to the accompanying drawings, wherein.

DESCRIPTION OF THE PREFERRED EMBODIMENTS

Figure 1:
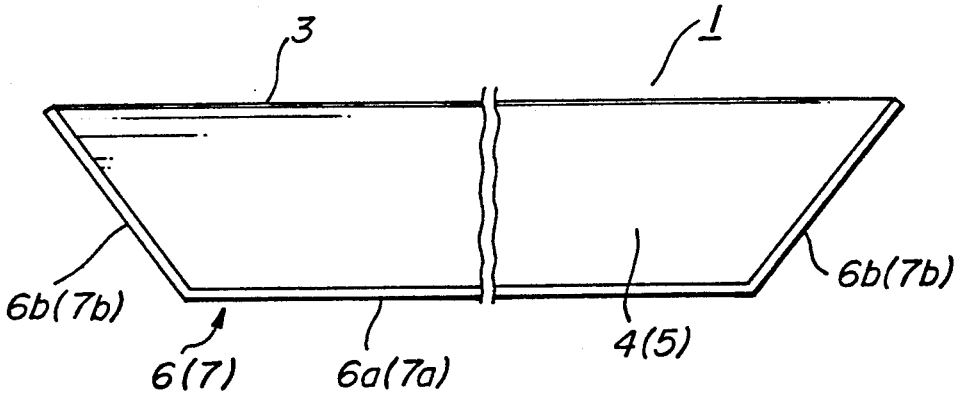
FIG. 1 is a schematically plan view of a rubber sheet at folded and piled state according to the invention.

In FIG. 1 is shown an embodiment of a rubber bag 1 made from a well-known flexible material constituting a dam body according to the invention, which is formed by folding a strip-like rubber sheet at a folded portion 3 to form an upper sheet portion 4 and a lower sheet portion 5 and closely joining edges 6, 7 of the sheet portions 4, 5 to each other. Moreover, such joining is simultaneously carried out when the rubber sheet is fixed onto a river as mentioned later.

Figure 3:
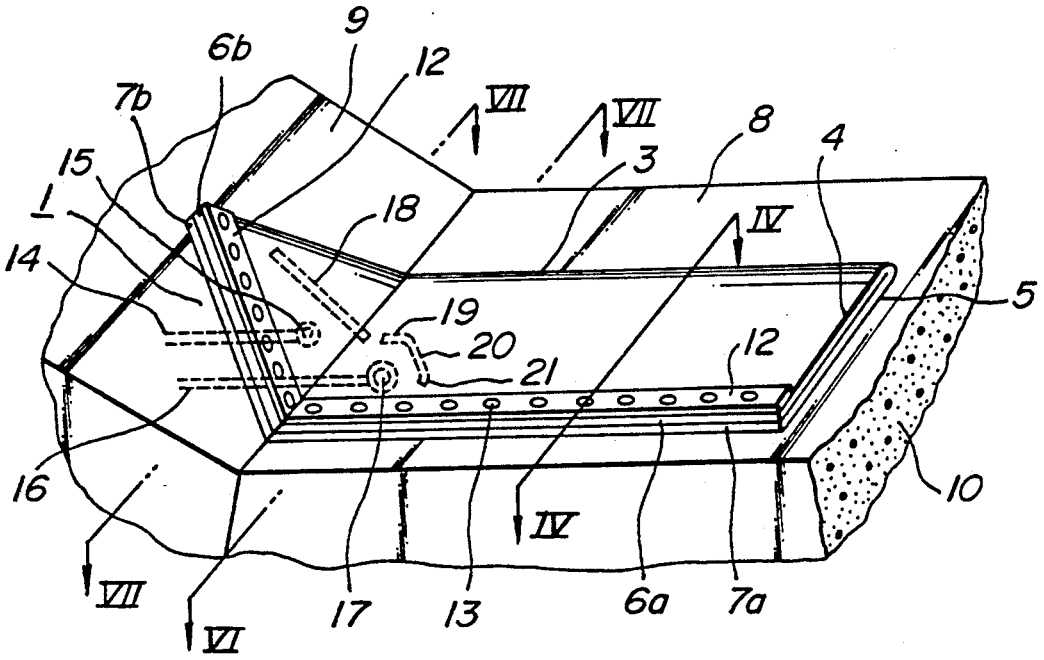
FIG. 3 a partly perspective view of the rubber bag according to the invention fixed onto a river.

The joint edges 6, 7 comprises front edges 6*a*, 6*b* and side edges 6*b*, 7*b* slantly extend backward from both ends of the front edges 6*a*, 7*a* to the folded portion 3. Each of the front edges 6*a*, 7*a* is a portion corresponding to a riverbed portion 8 in the fixing onto a river, while the side edges 6*b*, 7*b* are portions corresponding to riverbank portions 9 of the river as shown in FIG. 3.

Figure 4:
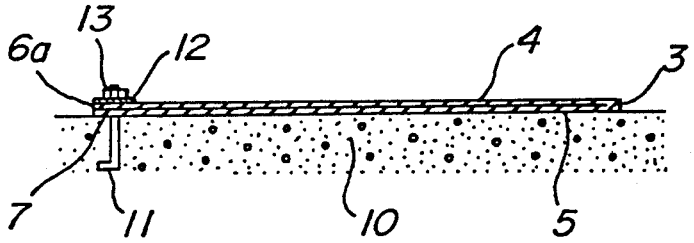
FIG. 4 is a sectional view taken along a line IV—IV of FIG. 3.

The fixing of the rubber bag 1 onto the river will be described below. As shown in FIGS. 3, 4 and the like, the upper and lower sheet portions 4, 5 are fixed onto a concrete base 10 formed over a region ranging from the riverbed portion 8 to the riverbank portions 9 by inserting anchor bolts stood in the concrete base 10 at a proper interval into holes formed in each of the edges 6, 7 of the sheet portions 4, 5 and placing a pushing member 12 on the edges 6, 7 of the upper sheet portion 4 over a full length thereof and clamping them by means of nuts 13. By such a clamping are closed the edges 6, 7 of the upper and lower sheet portions 4, 5 with each other to form a fluid-tightly sealed rubber bag 1.

In the lower sheet portion 5 constituting the rubber bag 1 is formed a fluid supply and discharge port 15 at a position corresponding to an opening of a fluid supply and discharge pipe 14 disposed in one of the riverbank portions 9. The fluid supply and discharge pipe 14 is fixed to the fluid supply and discharge port 15 when the rubber bag is constructed in the river.

Further, a drain-removing pipe 16 is embedded in the concrete base to open to the riverbed portion 8 in the vicinity of the riverbank portion 9 provided with the fluid supply and discharge pipe, while a drain-removing port 17 is formed in the lower sheet portion 5 at a position corresponding to the opening of the pipe 16. Similarly, the drain-removing pipe 16 is fixed to the drain-removing port 17 in the construction of the rubber bag.

Figure 2:
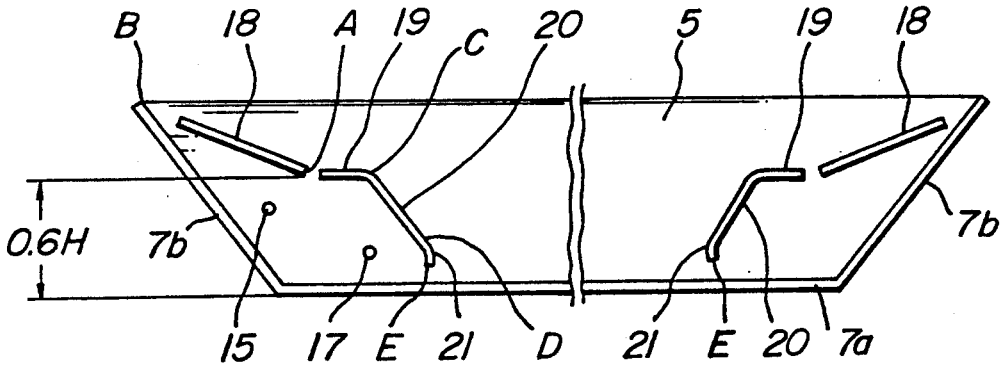
FIG. 2 is a schematically enlarged view of a folded lower sheet portion fixed onto a river.
Figure 5:
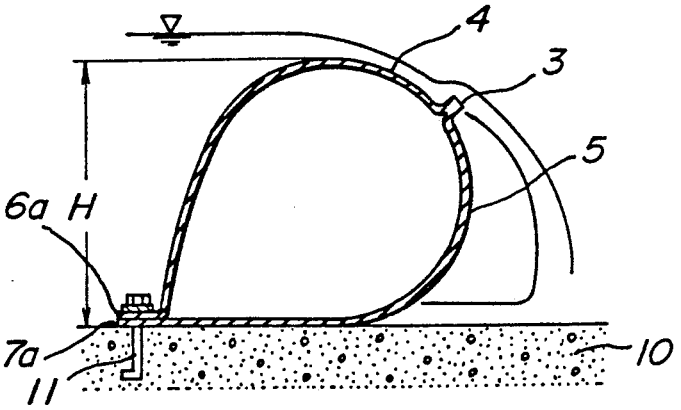
FIG. 5 is a section view showing an inflated state of the rubber bag.

According to the invention, as shown in FIG. 2, a substantially straight fastening part 18 is arranged behind the fluid supply and discharge port 15 of the lower sheet portion 5 (downstream side) over a region ranging from a point A of the riverbed portion 8 in the vicinity of the lower end of the riverbank portion toward the riverbank portion 9. This fastening part 18 has a proper length along a line connecting the point A, which is a distance from the front edge *7a* of the lower sheet portion 5 corresponding to 0.6 H when a height of the rubber bag 1 at an inflated state (dam height) is H in the filling of air into the inside of the rubber bag 1 as shown in FIG. 5, to an intersect between the side edge *7b* of the lower sheet portion 5 provided with the fluid supply and discharge port and the folded portion 3 or a top B of the side edge *7b*. Moreover, the point A is not necessarily 0.6H, but is sufficient to be not more than 0.6 H. For this end, the fastening part 18 is arranged behind the fluid supply and discharge port 15 and before the above line.

Furthermore, a fastening part 19 having a relatively short length (usually 1–2 m ) is arranged in the lower sheet portion 5 from the vicinity of the above point A in parallel to the front edge *7a*, and a fastening portion 20 connected to the fastening part 19 at an arc (¼ circle) is arranged to slantly and straightly extend from a top C of the fastening part 19, and a fastening part 21 connected to the fastening part 20 at an arc (¼ circle) is arranged to extend from a top D of the fastening part 20 in a direction substantially perpendicular to the front edge *7a*. A top E of the fastening part 21 is located in the vicinity of the front edge *7a*.

The fastening parts 18–21 of the lower sheet portion 5 are located so as to surround the fluid supply and discharge port 15 and further the drain-removing port 17 as shown in FIGS. 2 and 3. These fastening parts are fixed onto the riverbed portion 8 and riverbank portion 9 through pushing members 12 by means of anchor bolts 11 and nuts before the fixing of the joint edges 6, 7 of the sheet portions 4, 5. Although the fastening parts 18–21 of the lower sheet portion 5 are described with respect to the riverbank portion side provided with the fluid supply and discharge port 15, as shown in FIG. 2, these fastening parts 18–21 are symmetrically arranged on the riverbed portion and riverbank portion not provided with the fluid supply and discharge port and fixed thereonto in the same manner as described above.

Figure 6:
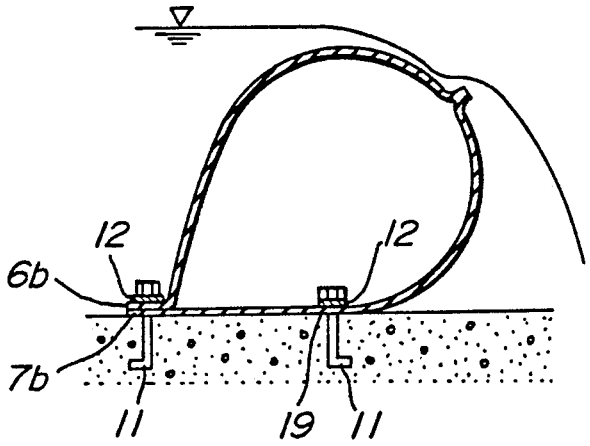
FIGS. 6 and 7 are sectional views showing inflated states of rubber bag along lines VI—VI and VII—VII of FIG. 3.
Figure 7:
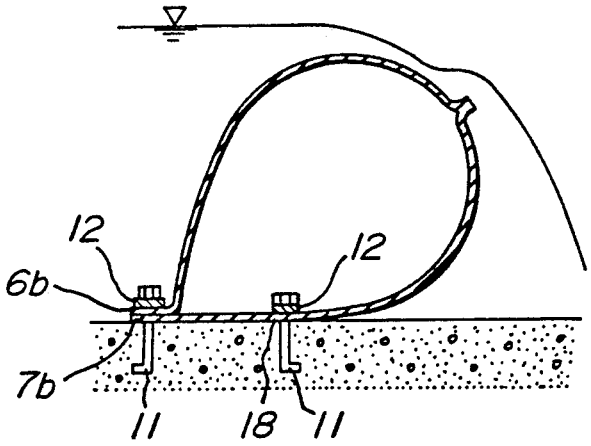

Thus, the left and right fastening parts 18–21 and the joint edges 6, 7 of the upper and lower sheet portions 4, 5 are fixed in the river to form a dam body comprised of the rubber bag 1 and having an inflated state as shown in FIGS. 5 to 7. In this case, the fastening part to the riverbed portion 8 is not arranged between the tops E, E of the fastening parts in the lower sheet portion 5, which is a one-side fixing system of fixing only the front edges *6a* and *7a* of the rubber bag.

In the dam of the above structure, the portion of the lower sheet portion is fixed over a region ranging from the riverbank portion to the riverbed portion behind the fluid supply and discharge port 15 and therearound, so that even if the water depth at the downstream side of the dam increases in the deflation course of the dam, tensile force applied to the portion surrounding the fluid supply and discharge port and the portion corresponding to the point B at tops of the edges 6, 7 can be controlled to prevent the occurrence of cramping at these portions.

In the rubber sheet dam of one-side fixing system, when water is fully dammed at the upstream side and the water depth is zero at the downstream side, the length of the rubber bag corresponding to about 0.6 times of the dam height usually contacts with the riverbed portion to make the rubber bag stable. However, as the water depth at the downstream side increases, the rubber bag gradually rises up during deflation while reducing the contacting length with the riverbed portion, and consequently the cramping as mentioned above is generated.

For this end, according to the invention, the surrounding of the lower sheet portion causing a fear of generating the cramping as mentioned above is fixed onto the riverbed and riverbank portion to prevent the cramping due to the rising-up of the rubber bag 1. Since it is not particularly required to fix the position of the lower sheet portion separated away from the front edge *7a* at a distance of more than 0.6 H, the maximum distance of the fastening part 19 from the front edge *7a* is 0.6 H. By such a restriction of the position of the fastening part 19 the difference in dam height of the lower sheet portion between the fastening part and the unfastening part in the rising-up of the rubber bag 1 can be minimized.

Figure 8:
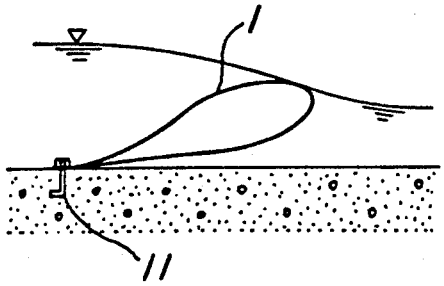
FIG. 8 is an outline view of a rubber bag at a deflated state.
Figure 9A:
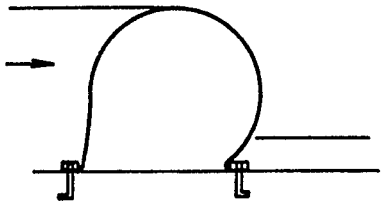
PRIOR ART FIG. 9a
FIGS. 9*a* to 9*e* are schematic views showing steps of gradually deflating the conventional rubber bag of two-side fixing system from an inflated state thereof.
Figure 9B:
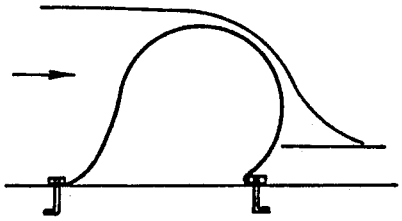
Figure 9C:
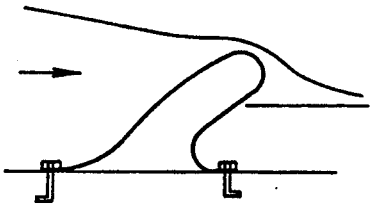
Figure 9D:
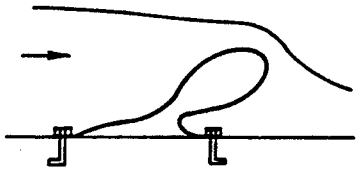
Figure 9E:
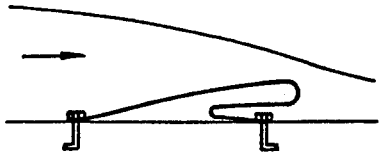

Furthermore, the portion corresponding to the riverbed portion other than the portion surrounding the fluid supply and discharge port and drain-removing port in the rubber bag 1 is fixed onto the riverbed portion 8 at only the front edges 6, 7 but is not fixed at the downstream side which is different from the two-side fixing system. Thus, if the water depth at the downstream side increases and water pressure at the downstream side increases in the deflation of the rubber bag 1, there is formed no bent portion because the rubber bag 1 rotatably deforms around the fixed portion in up and down directions in accordance with the water pressure (see FIG. 8).

As mentioned above, according to the invention, even when the water depth is created at the downstream side of the dam in the deflation, there is no fear of causing the cramping of the bag body comprised of the flexible sheet at the fastening part for the fluid supply and discharge port and the fastening parts on both upper riverbank portions, and also the bending of the bag is not caused, so that the distortion of the overflowing water is not created and damage of the bag due to the bending can be prevented.

Furthermore, the great part of the riverbed portion is a so-called one-side fixing system, so that the cost of the dam as a whole as well as the number of working steps can be reduced.

What is claimed is:

1. A collapsible sheet dam comprising; a flexible rubber sheet bag fixed onto riverbed and riverbank portions of a river in a direction crossing with the river, a fluid supply and discharge port formed in the bag and opening to a surface of the riverbank portion for the inflation and deflation of the bag, means for fixing free end portions of folded parts of said sheet onto said riverbed and riverbank portions at an upstream side of the river for the formation of said bag, a portion of a lower folded part provided with said fluid supply and discharge port being fixed by said means for fixing onto the riverbank portion in a region ranging from the riverbank portion to the riverbed portion at a downstream side of said port so as to surround a portion of said fluid supply and discharge port.

2. The collapsible sheet dam according to claim 1, wherein said portion of the bag located downstream the fluid supply and discharge port is fixed so as to be located at a position of not more than 0.6 times of dam height in the inflation of the dam from a front edge of said bag at a upstream side.

3. The collapsible sheet dam according to claim 1, wherein said means for fixing comprises; a substantially straight fastening portion positioned downstream of said supply and discharge port and an arcuate fastening portion positioned downstream of said supply and discharge port and outward from said riverbank.

4. The collapsible sheet dam according to claim 1, wherein said substantially straight fastening portion is secured to said riverbank and said arcuate fastening portion is secured to said river bed.

5. The collapsible sheet dam according to claim 3, wherein said means for fixing further includes a second substantially straight fastening portion positioned on an opposite side of said sheet and a second arcuately fastening portion positioned under said second substantially straight fastening portion.

6. The collapsible sheet dam according to claim 1 further comprising a drain removing port in said riverbed in communication with said flexible rubber sheet bag.

* * * * *